United States Patent [19]

Gibilisco et al.

[11] Patent Number: 4,653,668

[45] Date of Patent: Mar. 31, 1987

[54] MEDICAMENT DISPENSING CONTAINER

[75] Inventors: Kenneth J. Gibilisco, Warminster, Pa.; Stephen Degnen, Columbus, Ohio; Richard Borders, Houston, Tex.

[73] Assignee: Merck & Co., Inc., Rahway, N.J.

[21] Appl. No.: 749,380

[22] Filed: Jun. 27, 1985

Related U.S. Application Data

[63] Continuation of Ser. No. 494,462, May 13, 1983, abandoned, which is a continuation-in-part of Ser. No. 300,783, Sep. 14, 1981, abandoned, which is a continuation-in-part of Ser. No. 296,747, Aug. 31, 1981, abandoned, and Ser. No. 205,491, Nov. 10, 1980, abandoned.

[51] Int. Cl.[4] ..... B65G 59/06

[52] U.S. Cl. ..... 221/298; 206/540; 221/263; 221/289

[58] Field of Search ..... 221/190, 202, 264, 260, 221/288, 289, 297–299, 293, 294, 301, 306–308, 310; 206/540; 141/351, 352, 311 R, 320, 322, 321, 379–381

[56] References Cited

U.S. PATENT DOCUMENTS

| | | | |
|---|---|---|---|
| 3,004,566 | 10/1961 | Raimo | 221/289 X |
| 3,067,787 | 12/1962 | Salk | 221/289 |
| 3,182,694 | 5/1965 | Raimo | 221/289 X |
| 3,189,222 | 6/1965 | Smalley | 221/288 X |
| 3,300,090 | 1/1967 | Carden | 221/298 X |
| 3,409,172 | 11/1968 | Madsen | 221/289 X |
| 3,480,182 | 11/1969 | Rigor | 221/288 |
| 3,604,593 | 9/1971 | Curci | 221/288 |
| 3,620,413 | 11/1971 | Borsum | 221/289 |
| 3,622,041 | 11/1971 | Borsum et al. | 221/288 X |
| 3,637,109 | 1/1972 | Stifter | 221/288 X |
| 3,833,147 | 9/1974 | Borsum et al. | 221/202 |
| 3,896,968 | 7/1975 | Pehr | 221/288 |

*Primary Examiner*—Joseph J. Rolla
*Assistant Examiner*—Kevin P. Shaver
*Attorney, Agent, or Firm*—Richard A. Elder; Hesna J. Pfeiffer; Julian S. Levitt

[57] ABSTRACT

A container for storing and dispensing small objects, such as capsules or pills containing medicament, one at a time, consists of a receptacle containing, within itself, a delivery mechanism including a funnel-shaped exit port for capsules and a capsule or pill delivery tube at the end of said funnel-shaped exit designed to accommodate no more than one pill or capsule. This funnel divides the outer receptacle into an upper storage compartment and a lower delivery compartment. The receptacle also contains between the exit end of the receptacle and the delivery tube a resilient gate member positioned to prevent or allow escape of a capsule or pill from the delivery tube. The inner end of the receptacle is pressed into or twisted in the user's hand which moves the resiliently mounted gate members, thus opening the delivery tube and delivering a single small object to the user. The user then releases pressure on the exit end of the receptacle which at the same time releases the resilient gate allowing them to return to the rest position thus preventing the exit of the second small object until the cycle is restarted.

19 Claims, 31 Drawing Figures

Fig. 5.
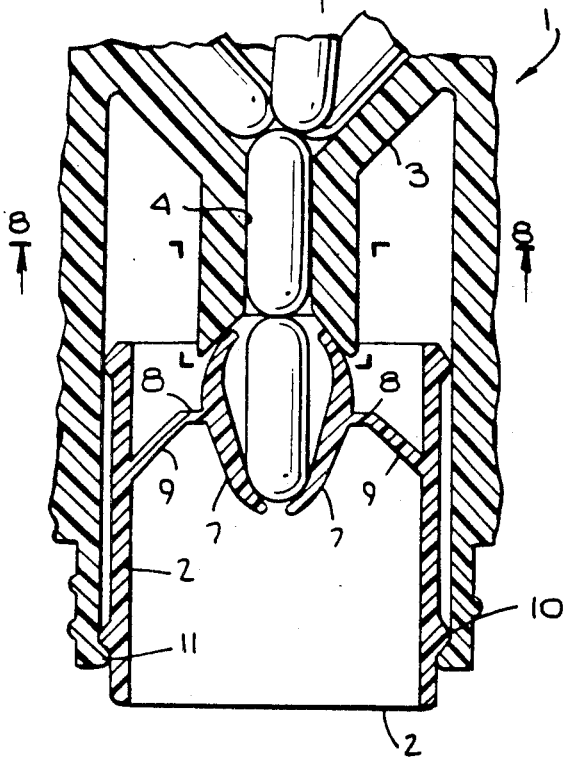
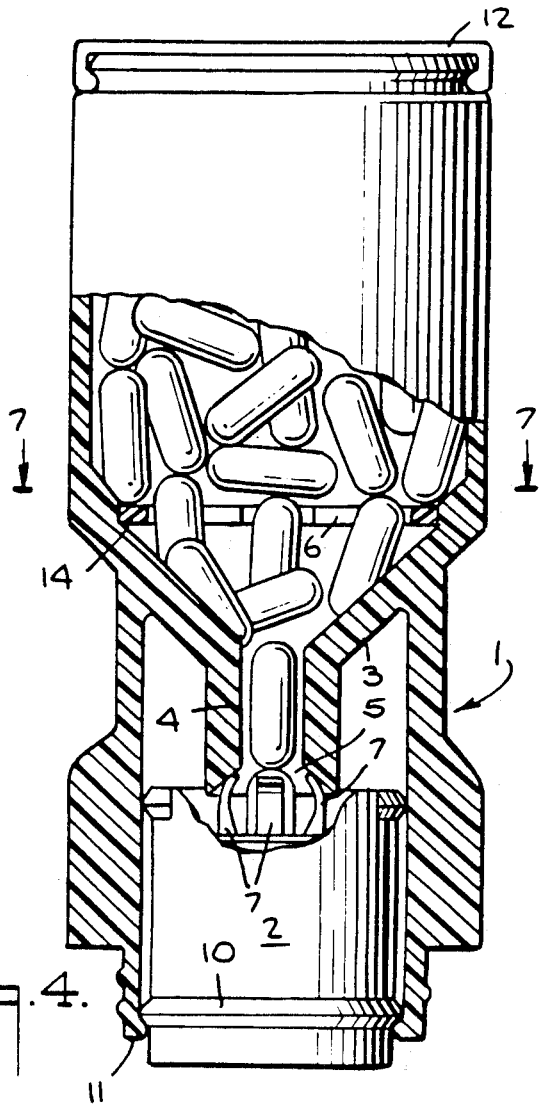
Fig. 4.
Fig. 6.
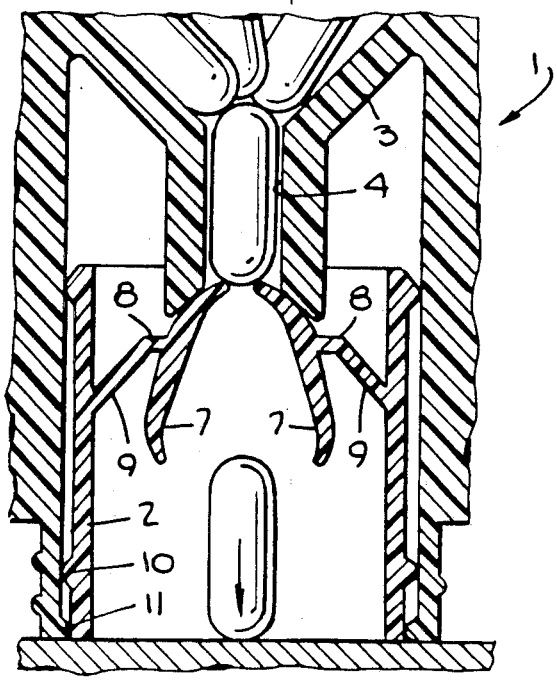
Fig. 7.
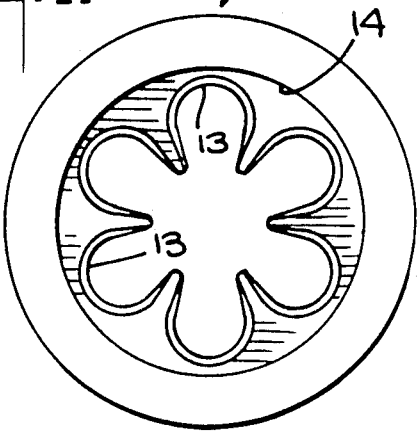

MEDICAMENT DISPENSING CONTAINER

This is a continuation, of application Ser. No. 494,462, filed May 13, 1983, now abandoned, which is turn it a continuation-in-part of application Ser. No. 300,783 filed Sept. 14, 1981, now abandoned, which in turn is a continuation-in-part of application, Ser. No. 205,491, filed Nov. 10, 1980, now abandoned and also of application Ser. No. 296,747, filed Aug. 31, 1981, now abandoned.

BACKGROUND OF THE INVENTION

Packages for sold medicaments in the past have appeared in a number of forms and in various degrees of complexity. The common container used by pharmacies for the dispensing of pills and capsules is an open-ended glass or plastic cylinder with a cap closure to retain the medicament when not being dispensed. The cap closure is sometimes a screw cap or alternatively may be a plastic snap-off cap or any of a variety of child resistant closures that require careful alignment of cap position in order to remove it from the container. Such caps rather than simplifying the opening and closing of containers usually make the process more difficult.

Certain of the prior art devices are especially designed to act as containers for the delivery of one unit of medication; e.g. a single capsule or pill at a time. Such devices are disclosed in certain U.S. patents. With reference to the delivery of single capsules, U.S. Pat. No. 4,154,365 discloses a dispensing container for single capsules which is essentially a pair of axial, telescoped members in which the inner member carries a stack of pills or other articles to be dispensed and the inner member may be reciprocated within the outer member between a normal, non-dispensing position and the dispensing position. The tubular members have openings which register when the inner member is depressed relative to the outer member, to allow the lowermost article of the stack to pass through the registered dispensing openings by gravity. One of the drawbacks of this type of dispenser is that the openings must be carefully registered and held in place until the article drops out. Thus, with this disclosure and others requiring careful manual manipulation, there is difficulty, for a patient having limited or painful finger mobility, in using such devices.

Austrian Patent No. 337,907—July 25, 1977 discloses a device for holding and delivering one or two pills at once. The structure disclosed is a cylinder terminating in a funnel shaped conduit for tablets and a hemispherical cap split vertically. The cap is held together by an outer cylindrical housing enclosing the inner cylinder and terminating in an open ended cone which is withdrawn to open the cap and prevent the release of other pills by the insertion of stops in the pill delivery tube. The device appears to require some manual dexterity to operate and would therefore be difficult to operate by a patient with limited finger mobility.

The following patents also describe devices for packaging and delivering medicaments.

1. U.S. Pat. No. 3,159,308, L. Passavanti
   Issued Dec. 1, 1964
2. U.S. Pat. No. 3,095,085, L. Meijer
   Issued June 25, 1963
3. U.S. Pat. No. 3,863,804, Infante-Diaz et al.
   Issued Feb. 4, 1975
4. U.S. Pat. No. 4,154,365, A. Lorca
   Issued May 15, 1979.

None of these patents disclose any device which suggests applicants' claimed invention. Thus, each of the devices of the above 4 reference patents, requires careful manipulation by the user in order to register corresponding openings in an inner container and an outer container to provide an exit port for a single tablet. The outstanding difference between applicant's device and the 4 listed patents is that applicants do not require the careful registration of two separate openings in their device, nor is it required to carefully manipulate the device claimed in order to allow the exit of a single tablet.

U.S. Pat. No. 3,159,308 of Passavanti discloses a device comprising a pair of tubular members having corresponding openings in the inner and outer shell of tubular members. As the opening of the two members are brought into registry, the lowest capsule in the stack in the inner tube is allowed to exit from the portal.

U.S. Pat. No. 3,095,085 of L. Meijer discloses a container comprising an outer cylindrical shell and a centrally compartmented or recessed core having side pockets which cooperate with a surrounding shell whereby the side pockets are brought into registry with an opening in the outer shell. Here again careful manipulation of the device is required.

U.S. Pat. No. 3,863,804 of Infante-Diaz discloses a container for dispensing one capsule at a time, which has a rotary member carrying spaced radial walls fitted within a cylindrical body. This device has internal compartments which are brought into alignment with a corresponding opening in the outer wall to permit delivery of the capsules. In addition the device contains a closure gate for the opening.

U.S. Pat. No. 4,154,365 of Lorca discloses a container which comprises two receptacles one within the other, each having an opening in its respective wall. In order to allow capsules to be delivered, the two containers are manipulated in such a way as to align the inner and outer openings so that one capsule at a time may be dispensed. Here again careful manipulation and control of the device is required to permit exit of a tablet from the container.

SUMMARY OF THE INVENTION

A container for storing and dispensing small objects, such as capsules or pills containing medicament, one at a time, consists of a receptacle conduit containing, within itself, a delivery mechanism includinq a funnel-shaped guide port for capsules and a capsule or pill delivery tube at the end of said funnel-shaped guide designed to accommodate no more than one pill or capsule. This funnel divides the outer receptacle into an upper storage compartment and a lower delivery compartment. The receptacle also contains between the exit end of the receptacle conduit and the delivery tube a resilient gate member means positioned to prevent or allow escape of a capsule or pill from the delivery tube. The inner end of the receptacle is pressed into or twisted in the user's hand which moves gate opening means against the resiliently mounted gate members thus opening the delivery tube and delivering a single small object to the user. The user then releases pressure on the exit end of the receptacle which at the same time releases the resilient gate means allowing them to return to the rest position thus preventing the exit of the second small object until the cycle is restarted.

A preferred form of the present invention provides a simple container for holding a number of capsule or pill shaped small objects and dispensing them one at a time. The dispensing device allows an individual with limited finger mobility to readily operate the device. The container, because of its unique construction, is especially adapted for the delivery of small objects such as capsules or tablets in a measured amount.

The dispensing device comprises two receptacles one telescoped inside the other and a resilient means acting as a gate between the upper storage compartment and the lower delivery compartment. The first of these receptacles contains an upper compartment which is separated from the lower compartment by a funnel-shaped capsule or pill delivery guide termination at its narrow end in a delivery tube adapted to accommodate cylindrical shaped capsules or disk-shaped tablets. The end of the delivery tube terminates in a beveled ramp acting as a delivery port and as a means for opening or closing resilient gate means attached to the inner structure of the second receptacle. The second of the receptacles is telescoped within the lower compartment of the first receptacle and is provided with bar members resiliently attached to the inner structure of said second receptacle. Said bar members, acting as a gate means, are positioned to slide against the beveled ramp of the capsule delivery tube when the lower receptacle is pressed into the upper receptacle to allow delivery of a single pill or capsule into the palm of the user's hand. Other forms and embodiments of applicants invention will be apparent from the following description and drawings.

DESCRIPTION OF THE INVENTION

A preferred embodiment of the invention, particularly adapted for use with capsules, is described below.

The design of the present dispensing device consists of two receptacles, one telescoped within the other and a distributor plate.

The first of these receptacles is essentially a cylindrical storage container for capsules having one end preferably permanently closed. Alternately this first receptacle can be closed with a removable cap or may be fitted with a locking closure which may be joined directly to the neck of a standard capsule bottle thus providing a permanently attached dispensing device for said bottle. This first of said cylindrical members is divided into an upper storage compartment and a lower delivery compartment by a funnel-shaped capsule delivery guide integrally joined to the inner walls of said cylindrical member and terminating at its narrow end in a delivery tube, the end of which tube is provided with inwardly beveled walls forming a delivery tube ramp at the open terminal end acting as a delivery port.

The said cylindrical member is preferably further provided with a circular distributor plate or disk having a central opening preferably in the shape of a sexafoliate circle or a sexfoil, said distributor plate being closely fitted at its outer circumference to the inner walls of said cylindrical member and positioned immediately adjacent to the funnel-shaped capsule delivery guide.

A second receptacle of smaller diameter than said first cylindrical member is telescoped inside the first one allowing limited reciprocating motion within said first cylindrical member between a rest position and an operating position. The inner walls of said second cylindrical member are fitted with a plurality of arcuate members acting as an escapement alternately allowinq or preventing the passage of a small object from the upper storage compartment to the lower delivery compartment. Said arcuate members have both concave and convex surfaces and are resiliently mounted on flexible rodlike projecting members integrally attached to the inner walls of said second cylinder and positioned immediately below the capsule delivery port. Said arcuate members are adapted to be closed together at their upper extremities blocking the capsule delivery port in the operating position and adapted to be closed at lower extremities and form a claw-like cradle in the rest position. The resiliently mounted arcuate members are positioned against the capsule delivery tube ramp in such a way that the resiliently mounted arcuate members exert a force tending to force the inner receptacle out of the outer receptacle. The inner wall of the outer receptacle and the outer wall of the inner receptacle are provided with opposing shoulders extending circumferentially around said cylinders to limit the reciprocal motion of said inner cylinder and prevent the escape of the inner cylinder.

In an alternate embodiment of the invention especially adapted for use with tablets or similar disk shaped objects, the structure of the device is modified to accommodate the disk shape of the tablets. In this alternate embodiment the first or upper receptacle is fitted at the lower end of the funnel-shaped delivery guide with a tablet delivery tube which is essentially rectangular in cross section to align the tablets in edge to edge order. The delivery end of said tube is provided with outwardly beveled walls forming a gate opening and tablet delivery means. Said upper receptacle and funnel-shaped delivery guide are further provided with a fixed vertical dividing wall of diamond shaped cross section extending through part of the vertical dimension of the upper receptacle. This divider wall partially aligns the tablets for edge to edge entry into the tablet delivery tube. In this alternate embodiment the second or lower receptacle is provided with resiliently mounted finger or bar elements positioned to act as a gate to prevent delivery of a tablet when in the rest or non-operating position and to allow delivery of a single tablet when in the operating position. In this alternate embodiment a second receptacle is also telescoped inside the lower delivery compartment of the first receptacle allowing limited reciprocating motion within said first receptacle between a rest position and an operating position. The inner walls of said second receptacle are fitted with a framework structure bearing resiliently mounted bar members. Said bar members are mounted at their lower extremities so that the tablet delivery tube is partially blocked by the upper extremities of said bar members when in the rest position. The upper extremities of said bar members are slightly enlarged in cross section relative to the lower and middle parts of the bar members. The upper extremities of said bar members are positioned against the outwardly beveled tablet delivery tube ramp so that said upper extremities are spread apart, allowing a tablet to escape when the lower receptacle is pressed against a surface, such as the palm of the user's hand. Release of pressure allows the lower receptacle to return to the rest position blocking the tablet delivery tube and preventing escape of a tablet in the rest position.

OPERATION OF THE DISPENSING DEVICE

In order to operate the device it is only necessary to press the projecting inner cylinder into the outer cylinder until the capsule drops out of the device. It should be noted that pressing the inner cylinder into the outer cylinder forces the arcuate members against the inclined capsule delivery tube ramp (FIG. 6) preventing the escape of a second capsule from the capsule delivery tube by formation of a gate across the capsule delivery tube port. It should further be noted that when the device is in this operating position, the resiliently mounted arcuate members exert a force tending to force the inner cylinder out of the outer cylinder. At the rest position (FIG. 5), the ends of arcuate members adjacent the delivery tube ramp return to the open position allowing a capsule to enter the claw-like cradle formed by the closed lower ends of the arcuate members in the rest position.

In an alternate embodiment of the present invention the length of said arcuate members may be varied so that a measured number of small objects can be delivered at one time. It should be noted that the number of small objects which may be delivered at one time is directly dependent on the length of the arcuate members. In the further alternate embodiment adapted for use with disk-shaped tablets, the device delivers tablets by pressing the inner receptacle into the outer receptacle until the tablet drops through the tablet delivery tube. When in the rest position (FIG. 9), the tablet exit port is blocked by the upper extremities of the resiliently mounted bar members. When the inner receptacle is pressed into the upper outer receptacle (FIG. 11), the resiliently mounted bar members are spread apart allowing a tablet to exit and said bar members exert a force against the outwardly beveled ramp tending to force the inner receptacle out of the outer receptacle. At the rest position the upper extremities of the resiliently mounted bar members partially block the tablet delivery port preventing further tablet escape.

A special feature of the invention is its simplicity of operation for individuals affected by disease which limits finger mobility. Thus such an individual need only invert the dispensing device and press lightly against the palm of his hand thus dropping a capsule into the hand.

It should further be noted that the container can be made of any suitable material preferably polyethylene, polypropylene, polystyrene, polyvinyl chloride, nylon, and the like. Preferably high density polyethylene is used for the body of the device, nylon is used for the construction of the resilient hinge member carrying the arcuate members, and polypropylene for the cap.

As previously indicated, the dispensing device may be closed at the storage end by any conventional closure device. Non-removable closures are preferred since the container is preferably filled by the manufacturer and discarded after use. The exit end of the device may also be fitted with a closure device such as a conventional screw cap, snap or a child-resistant closure.

BRIEF DESCRIPTION OF THE DRAWINGS

FIG. 4 is a longitudinal view of the container having a position of the outer casing viewed as transparent exposing the operational inner section of the container in relation to the outside dimension.

FIG. 5 is an enlarged longitudinal section of a position of the container in the rest position in which only the section of the container having moving parts is shown, in which a capsule is shown being held in claw-like cradle formed by the arcuate members in the rest position.

FIG. 6 is an enlarged longitudinal section of a portion of the container in the operating position in which only the section of the container having moving parts is shown, in which the two cylinders are in registry, forcing the arcuate members against the capsule delivery tube ramp forming a gate blocking a capsule from leaving the delivery tube while delivering a single capsule to the exit port.

FIG. 7 is a section of the storage part of the container at the distributor plate or disk showing the sexfoil or sexafoliate circle cut out in the disk to align the capsules in their entry to the funnel-shaped capsule delivery guide.

DETAILED DESCRIPTION OF THE INVENTION

Figure 1:
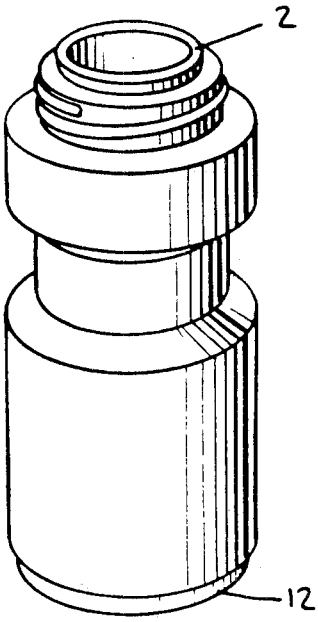
FIG. 1 is a front view of the medicament dispensing container in the inverted position for storage.
Figure 8:
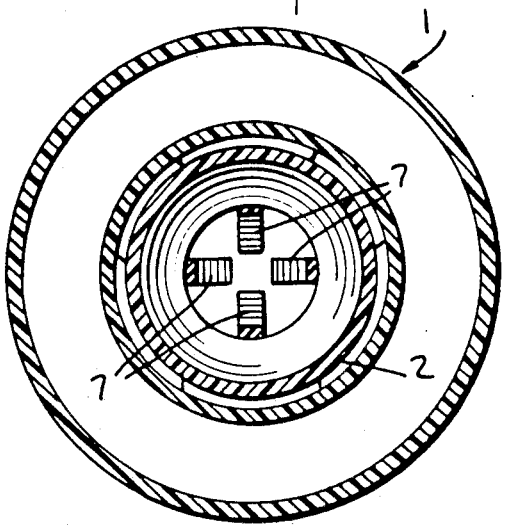
FIG. 8 is a view of a cross-section through the entire container showing the lateral displacement of the four arcuate members and the two telescoped cylinders and the outer casing.
Figure 3:
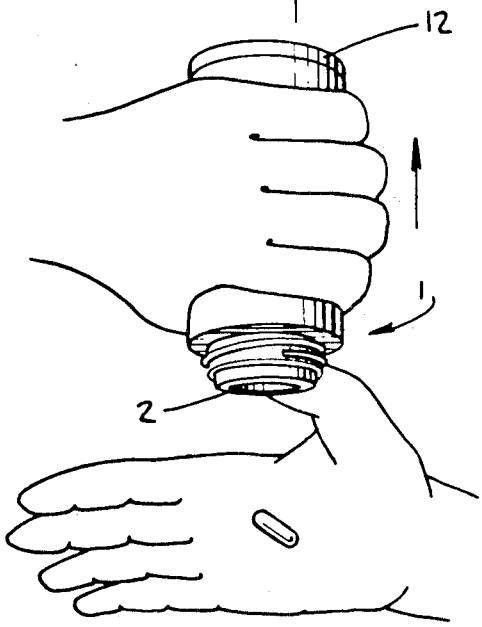
FIG. 3 is a view of the container as it would be used. As shown the capsule has been delivered by pressing the cylinders into the palm and has returned to the rest position.
Figure 2:
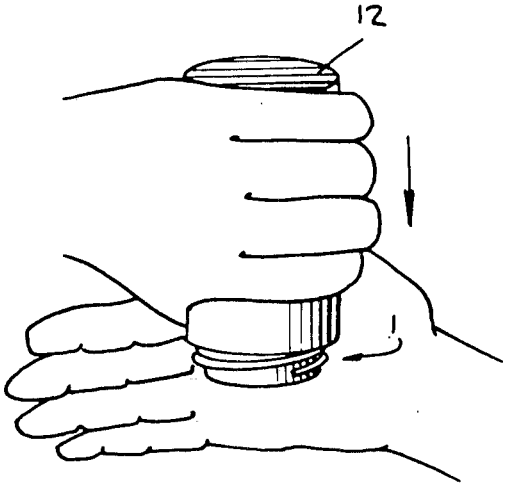
FIG. 2 is a view of the container as it would be used. As shown the capsule is in the operating position with the inner cylinder pressed against the palm of the users hand releasing the capsule into the palm.

Following is a detailed description of the invention with reference to the drawings and wherein the same numbers are used to indicate the same parts in different figures.

The dispensing device of the present invention comprises two main elements, an outer cylinder (1) and an inner cylinder (2) which is telescoped inside the outer cylinder.

A oreferred embodiment of the invention adapted for use with capsules is described as follows with particular reference to FIGS. 4–8 inclusive which show the internal working mechanism of the device.

The outer cylinder (1), which may have one end permanentlv closed or may be closed by means of a removable top (12), and is fitted with a funnel-shaped capsule delivery guide (3), integrally joined at its widest circumference to the inner surface of the outer cylinder (1). Preferably a distributor disk (6) is positioned immediately above the funnel-shaped guide to align small objects for entry to the funnel-shaped guide and prevent jamming of the guide. The funnel-shaped guide (3) is joined at its narrow end to a relatively thick walled capsule delivery tube (4) terminating in an opening provided by inwardly beveled walls forming a capsule delivery tube ramp (5). The funnel-shaped guide (3) is preferably located approximately midway between the extreme ends of the outer cylinder (1).

The inner cylinder (2) is telescoped within the outer cylinder (1) at the end enclosing the delivery tube (4) at the narrow end of the funnel-shaped capsule delivery guide (3). The inner cylinder (2) is reciprocally slidable within the outer cylinder between two positions. First, an operating position as shown in FIG. 6 when the ends of the inner cylinder (2) and the outer cylinder (1) are flush and second, a rest position shown in FIG. 5 wherein the inner cylinder (2) protrudes a small distance from the outer cylinder (1). The inner walls of the inner cylinder are provided with a plurality, preferably four, rod-like hinge supports (9) radially inwardly projecting and terminating in flat resilient hinge members (8) carrying arcuate members (7) forming a gate positioned in alignment with the longitudinal axis of the cylinder with concave surfaces of said arcuate members faced toward the longitudinal axis and convex surfaces faced toward the cylinder walls. These arcuate members are positioned immediately below the capsule delivery tube (4) so that one end of each member is in slidable contact with the bottom edge of the capsule delivery tube ramp (5).

Making reference to FIGS. 5 and 6, it is noticed that in FIG. 5 the dispensing device is in the rest position in which the lower ends of the arcuate members 7 are brought together forming a claw-like cradle suitable for holding a small object. The inner cylinder in this position is prevented from sliding further out of the outer cylinder by opposing ridges or shoulders (10) located circumferentially on the outer wall of the inner cylinder and a circumferential ring formed on the inner wall of the outer cylinder (11). In FIG. 6, representing the operating position the inner cylinder is flush with the outer cylinder exerting a vertical force transmitted through hinge support member (9), and resilient hinge member (8) and holding the upper ends of the arcuate member (7) in closed relationship acting as a gate preventing the exit of small objects from the capsule delivery tube (4).

In a preferred embodiment of the invention and in order to align and distribute the capsules as they enter the funnel-shaped capsule delivery guide (3), there is provided a removable disk (6) having a sexfoil opening (13), said disk being closely fitted to the inner wall of the upper compartment of outer cylinder (1) and placed at the circumferential junction (14) of the funnel-shaped guide and the inner wall of said outer cylinder.

Figure 9:
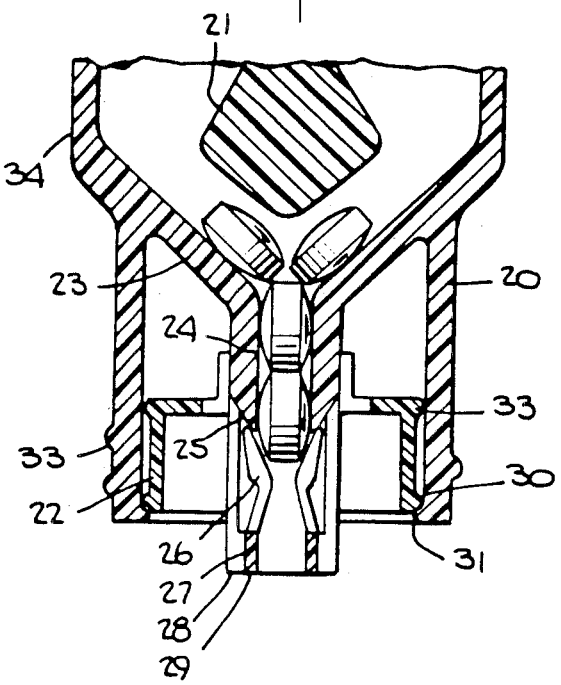
FIG. 9 is an enlarged longitudinal section of the alternate tablet device in which only the section of the container having moving parts is shown in which a tablet is blocked from leaving the tablet delivery tube in the rest position.
Figure 10:
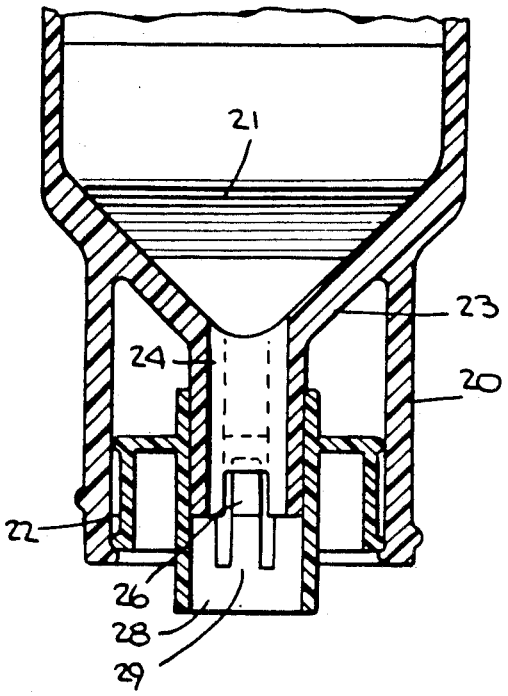
FIG. 10 is an enlarged longitudinal section of the alternate tablet device shown in FIG. 9 but rotated 90° around the longitudinal axis.
Figure 11:
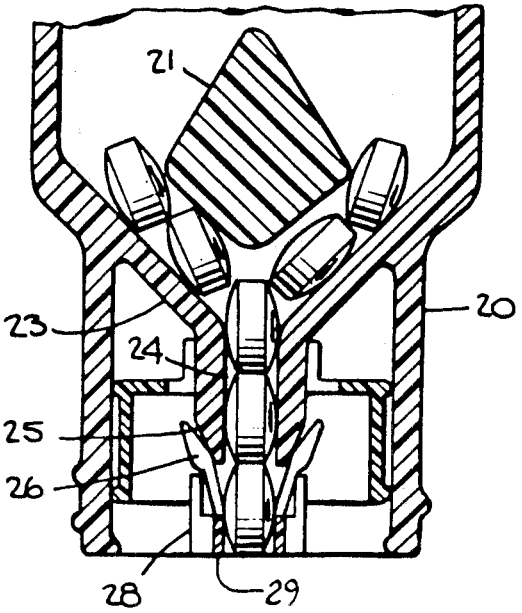
FIG. 11 is an enlarged longitudinal section of the alternate tablet device of FIG. 9 shown in the operating position.

An alternate preferred embodiment adapted for use with tablets or disk-shaped objects is described as follows with particular reference to FIGS. 9–11 inclusive which show the internal working mechanism of the device. The inner cylinder (22) is telescoped within the outer cylinder (20) enclosing the tablet delivery tube (24) at the narrow end of the funnel-shaped tablet delivery guide (23). The inner or lower cylinder (22) is reciprocally slidable between two positions, a rest position illustrated in FIGS. 9 and 10 and an operating position illustrated in FIG. 11. In the rest position the tablet is prevented from dropping out of the tablet delivery tube (24) by the enlarged upper end (26) of the vertically mounted bar member (27). In the operating position represented by FIG. 11 the inner (lower) cylinder (22) and the projecting inner framework structure (28) is pressed vertically into the outer cylinder (20) forcing the enlarged head (26) of the vertical bar member (27) against the tablet tube delivery ramp (25) thereby spreading the upper ends (26) of the bar members apart and allowing a tablet to drop from the tablet delivery tube (24). Release of pressure on the inner cylinder framework (29) allows the inner cylinder (22) to return to the rest position. The inner cylinder (22) is provided with external circumferential rings upper (33) and lower (30) external circumferential rings. The inner cylinder (22) is prevented from sliding completely free of the upper cylinder and is held in position to prevent tablet escape by contact of the lower circumferential ring (30) with an internal shoulder (31) acting as a stop at the lower end of the external receptacle (20).

This alternate embodiment in its preferred form contains a partial vertical divider wall (21) of diamond shaped cross section bisecting the upper storage compartment (34) of the upper receptacle and extending partially downward into the funnel-shaped tablet delivery guide (23). This divider wall serves to separate and align the tablets dropping into the tablet delivery guide (23) for edge to edge entry into the tablet delivery tube (24), which may be of a rectangular cross-section, thus helping to provide smooth operation of the device.

A number of alternate embodiments of the invention illustrated in FIGS. 12–31 inclusive are described below with particular reference to variation in the delivery mechanism and the method of operation. It should be appreciated that all of these variations share the ease of operation described for the preferred embodiments and thus are particularly adapted for individuals with limited finger mobility.

The alternate embodiments in general operate in the same manner as the embodiments previously described and include the same basic elements which however may be modified as to point of attachment or several may be combined into a single element. Thus each alternate embodiment includes a small object storage reservoir or means for attaching such a reservoir, an outer cylinder, an inner cylinder, a funnel shaped guide, a distributor means, a gate, and a gate opening means.

Figure 12:
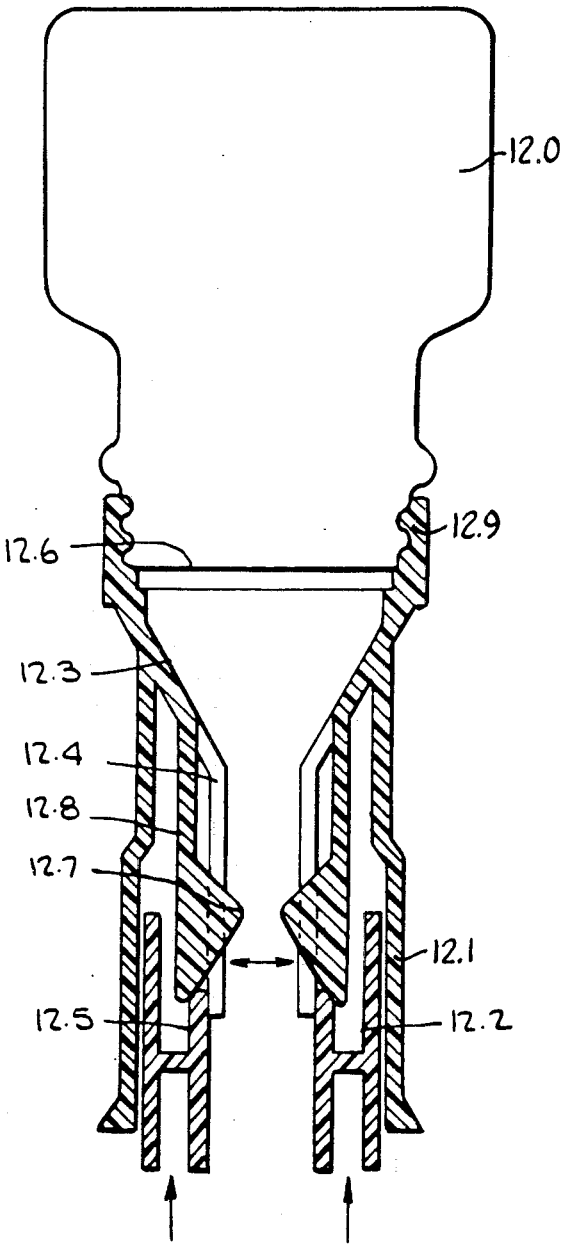
FIG. 12 is a longitudinal section of an alternate embodiment wherein the gate members are resiliently attached to the funnel guide.
Figure 13:
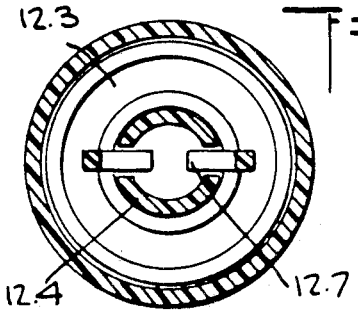
FIG. 13 is a cross section of said alternate embodiment showing the gate members at the blocking rest position.

In one such modified embodiment illustrated in FIGS. 12 & 13 a delivery device is attached by means of a locking closure 12.9 to a storage bottle 12.0 and when inverted, small objects pass through distributor means 12.6 and funnel guide 12.3 into delivery tube 12.4. When device is pressed into user's palm or other flat surface, the gate opening members 12.5, rigidly attached to inner cylinder 12.2 are pressed against the beveled ramp of gate member 12.7 which spreads the resiliently mounted gate members and allows a small object to drop from the delivery tube 12.4.

Figure 14:
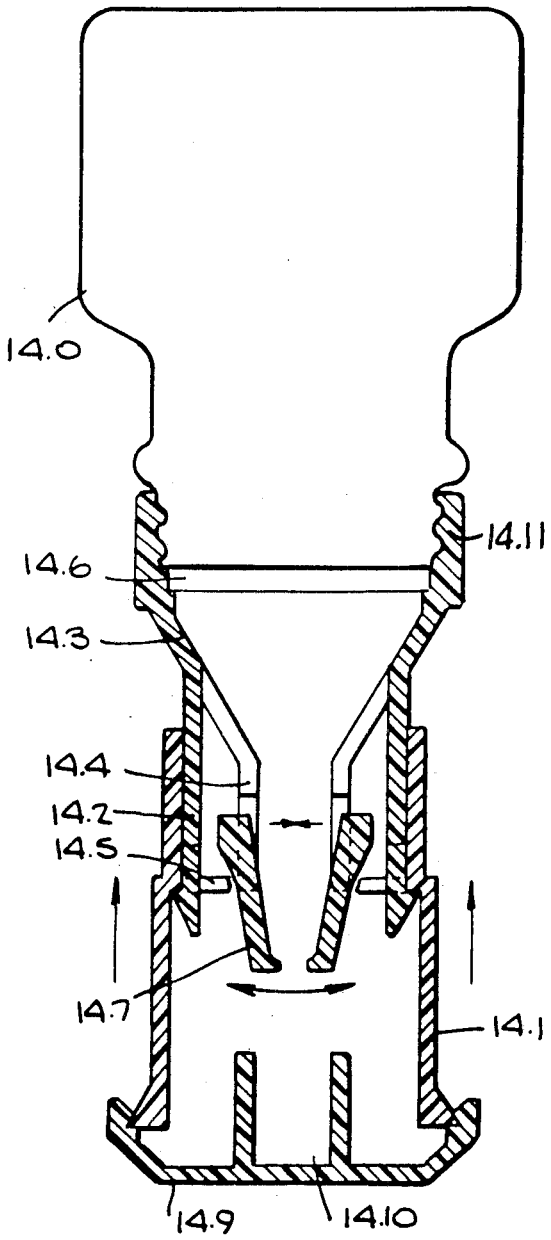
FIG. 14 is a longitudinal section of another alternate embodiment wherein the gate opening members are rigidly attached to the inner walls of the outer cylinder.
Figure 15:
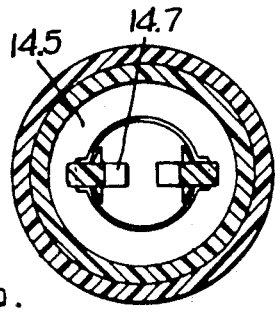
FIG. 15 is a cross section of said alternate embodiment showing the gate members at the blocking rest position.

In another modified alternate embodiment illustrated in FIGS. 14 & 15, the delivery device is attached by means of a locking closure 14.11 to storage bottle 14.0 and, when inverted, small objects pass through distributor means 14.6, funnel guide 14.3 and into delivery tube 14.4. The gate means 14.7 is pivotally mounted at the end of the delivery tube 14.4 so that the gate means blocks the release of objects from the delivery tube in the rest position. The object is released on inverting the entire device and pressing the delivery end cap 14.9 against a user's hand or a flat surface. Thus movement slides the outer cylinder 14.1 toward the storage container 14.0 moving the rigidly mounted gate opening members 14.5 against the gate members 14.7 providing a biasing force pivoting the gate members to an unblocking position and allowing escape of a single small object.

Figure 16:
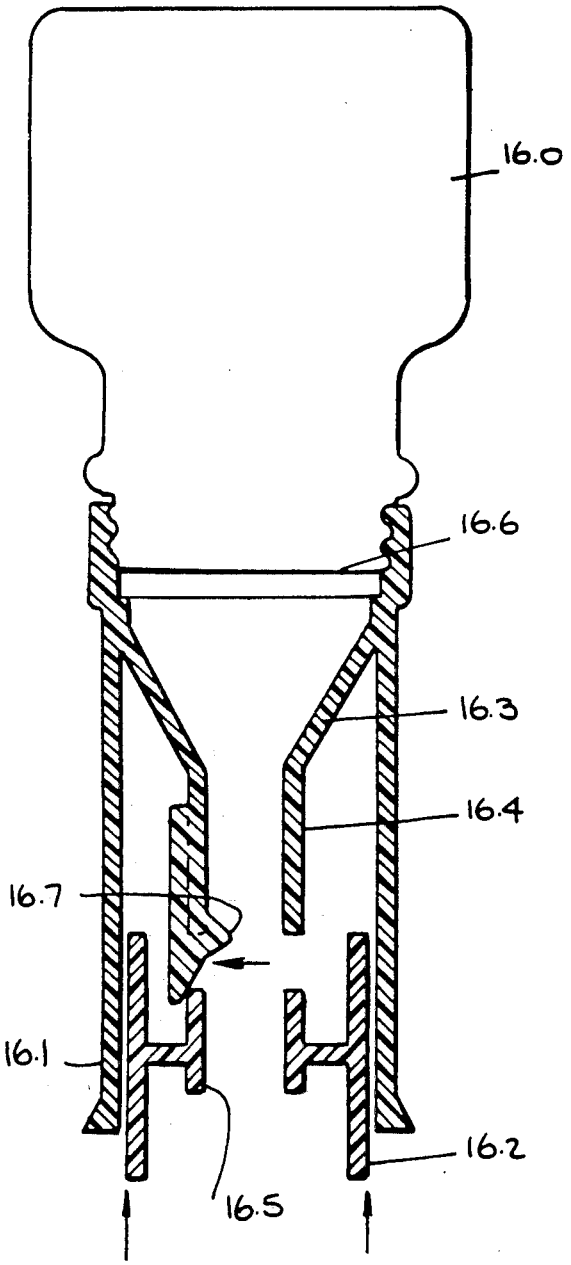
FIG. 16 is a longitudinal section of an alternate embodiment wherein a single gate member is resiliently attached to the funnel guide.
Figure 17:
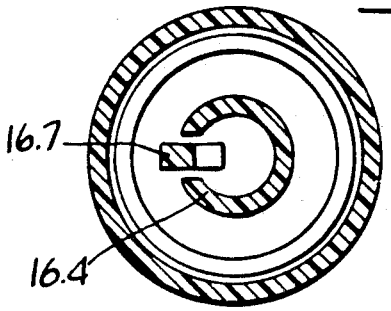
FIG. 17 is a cross section of said alternate embodiment showing the single gate member in the blocking rest position.

In a further modified alternate embodiment, illustrated in FIGS. 16 & 17, a storage bottle reservoir 16.0 is connected to a delivery device comprising an outer cylinder 16.1 incorporating an object distributor means 16.6, a funnel guide 16.3 and a delivery tube 16.4. Attached to the delivery tube is a resiliently mounted single gate means 16.7 comprising a bar member having a protuberance partly blocking the delivery tube in the rest position. Inside the outer cylinder 16.1 there is a telescoped inner cylinder 16.2 which extends beyond the outer cylinder and contains a rigidly mounted gate opening member 16.5 attached to the inner surface of said inner cylinder positioned so that the gate opening member will provide a biasing force to the gate member allowing a small object to pass through delivery tube 16.4 when the inner cylinder is pressed against a flat surface or the users palm delivering a small object from the reservoir.

Figure 18:
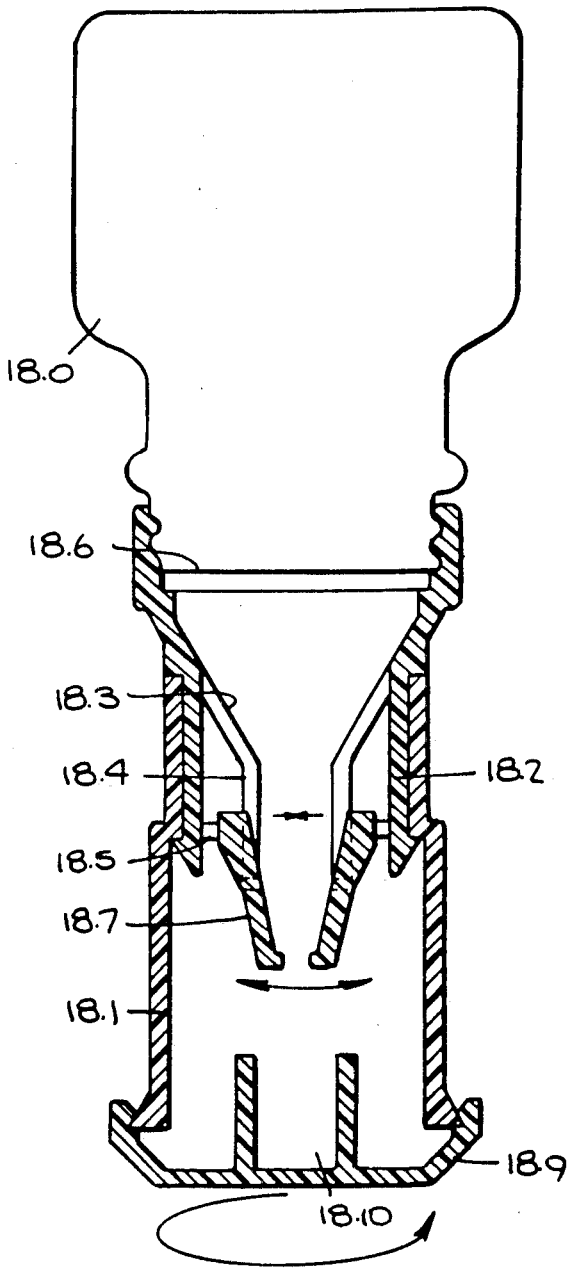
FIG. 18 is a longitudinal section of an alternate embodiment wherein the rigidly mounted gate opening members supply a biasing force to said gate members when lower cylinder is rotated.
Figure 19:
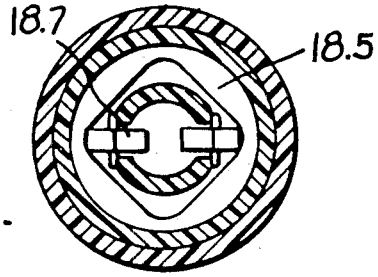
FIG. 19 is a cross section of said alternate embodiment showing the gate members at the blocking rest position.

In a further modified alternate embodiment described in FIGS. 18 & 19 a storage bottle reservoir 18.0 is connected to a delivery mechanism including a distributor means 18.6, and a funnel guide 18.3 terminating in a delivery tube 18.4. The gate means 18.7 is pivotally mounted on the delivery tube partially blocking the delivery tube in the rest position shown. The device is operated to open the gate means by twisting or rotating inner cylinder 18.2 within outer cylinder 18.1. The twisting motion brings a reduced inner opening of the rigidly, internally mounted gate opening members 18.5 against the upper end of the gate means 18.7 causing the upper ends to close and the lower ends to open allowing a small object to escape.

Figure 20:
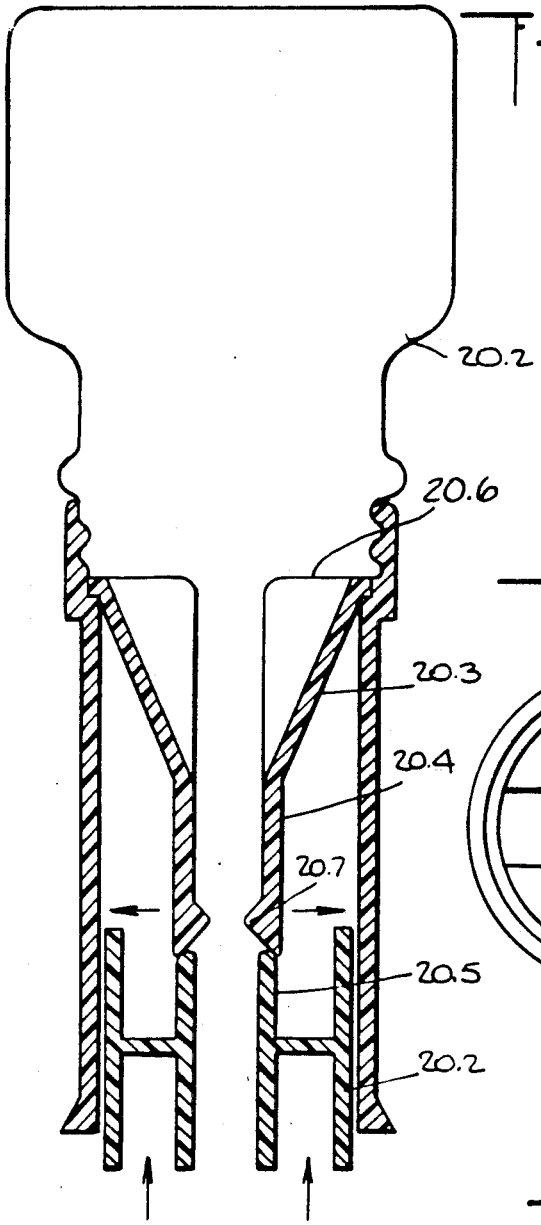
FIG. 20 is a longitudinal section of an alternate embodiment wherein the distributor structure is an integral part of the funnel guide.
Figure 21:
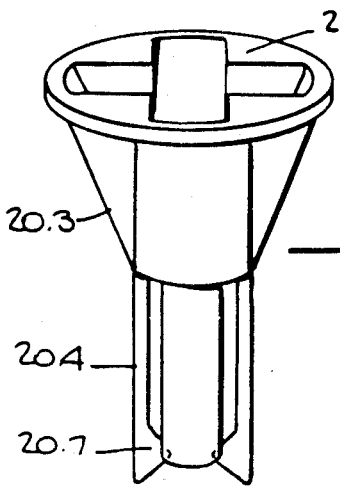
FIG. 21 is a perspective sight of said alternate embodiment with partially exposed inner structure.

In a further modified embodiment, illustrated in FIGS. 20 and 21, several elements of the delivery device are combined into an integrated element. Thus the distributer means 20.6, the funnel means 20.3, the delivery tube 20.4 are combined into a single structural element with gate means 20.7 resiliently mounted to the outside of the delivery tube with the end protuberances of the gate means partially blocking the delivery tube in the rest position. The device is operated by pressing the inner cylinder 20.2 onto a flat surface which forces the internally mounted bar members 20.5 against the beveled gate member protuberances 20.7 forcing them apart and allowing delivery of a small object from delivery tube 20.4.

Figure 22:
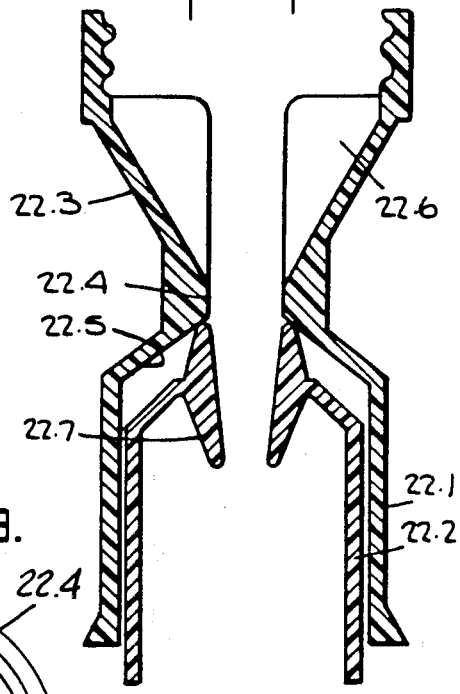
FIG. 22 is a longitudinal section of an alternate embodiment wherein the receptacle conduit connected to the storage bottle is integrally connected to the distributor structure and the funnel guide delivery tube.
Figure 23:
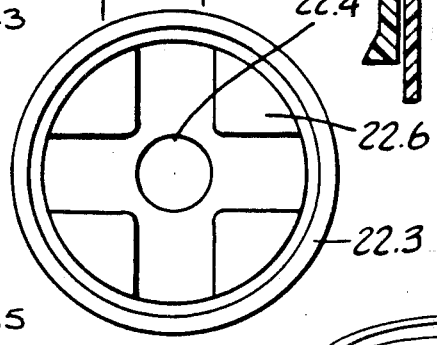
FIG. 23 is an overhead view of said alternate embodiment.
Figure 24:
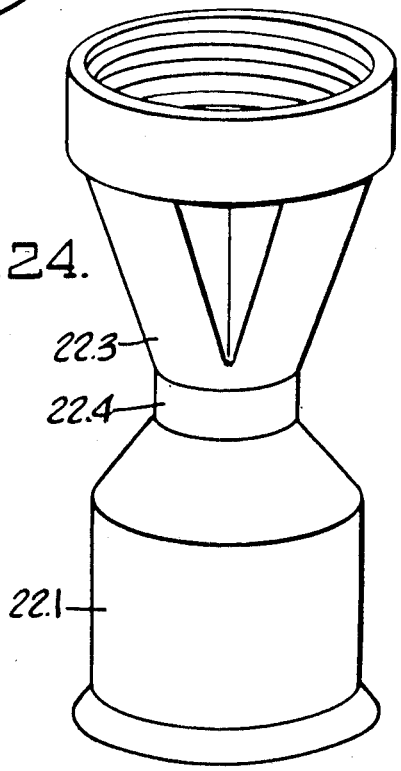
FIG. 24 is a perspective view with partially exposed inner structure of said alternate embodiment.

In a further embodiment illustrated in FIGS. 22, 23 and 24 the delivery mechanism, adapted for attachment to a storage bottle reservoir, combines all necessary functions into 2 combined elements comprising an inner cylinder 22.2 and an outer cylinder 22.1. The outer cylinder is formed to include a distributing means 22.6 and a funnel guide 22.3 and a delivery tube 22.4 as well as a slanted ramp 22.5 acting as a gate opening means. The inner cylinder is slidably mounted within the outer cylinder and to the upper rim of the inner cylinder there are resiliently mounted bar member 22.7 acting as a gate to prevent release of any objects in the rest position. When the lower end of the inner cylinder is pressed against a flat surface the upper ends of the gate bar members 22.7 are pressed against the slanted ramp 22.5 which blocks the delivery tube but opens the lower end of the gate bar members allowing delivery of a small object. When the pressure is released the lower ends of the gate bar members close preventing further delivery of objects until again pressed into the operating position.

Figure 25:
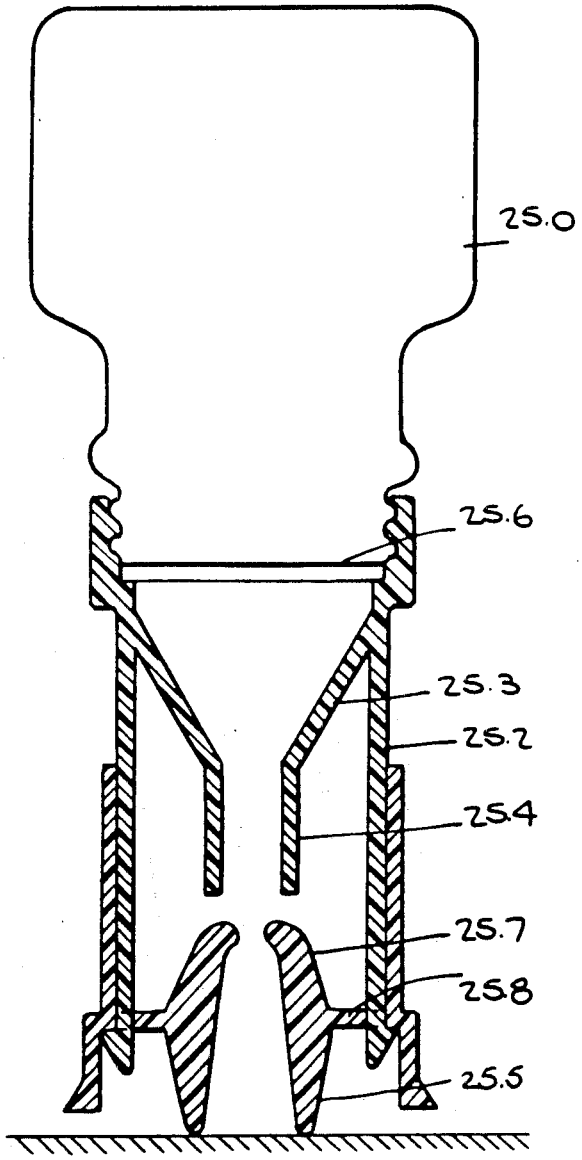
FIG. 25 is a longitudinal view of an alternate embodiment wherein the resiliently gate means is shown in the rest position blocking the delivery tube but with the gate means protruding from delivery end of the receptacle conduit.
Figure 26:
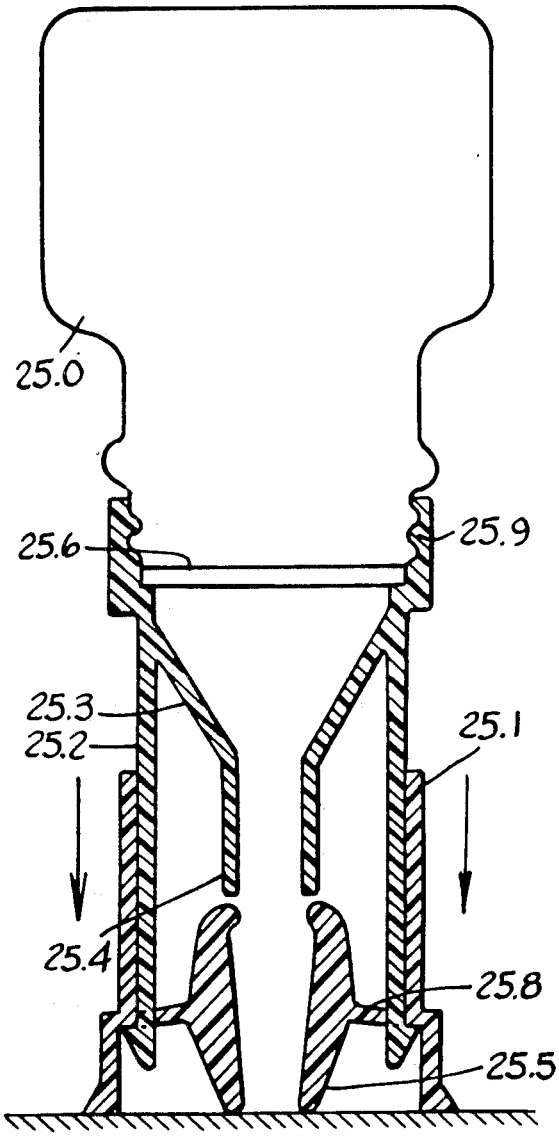
FIG. 26 is a similar view of said alternate embodiment with gate means pressed against a flat surface wherein the delivery tube is unblocked by the gate.

A further alternate embodiment illustrated in FIGS. 25 & 26 employs a different mode of opening and closing the gate members. In this embodiment the delivery device is connected by means of a locking closure 25.9 to a storage bottle reservoir 25.0. The objects contained in the storage bottle pass through a distributor means 25.6 and funnel guide 25.3 into delivery tube 25.4. In the rest position gate bar member 25.7 is resiliently mounted by means of a flexible support 25.8 in a vertical position partially blocking the exit end of the delivery tube with the lower end 25.5 of the gate bar member protruding from the delivery end of the device. In the operating position, the protruding end 25.5 of the gate bar member is pressed onto a flat surface spreading the upper end of the gate bar members 25.7 and allowing a small object to drop from the delivery tube 25.4.

Figure 27:
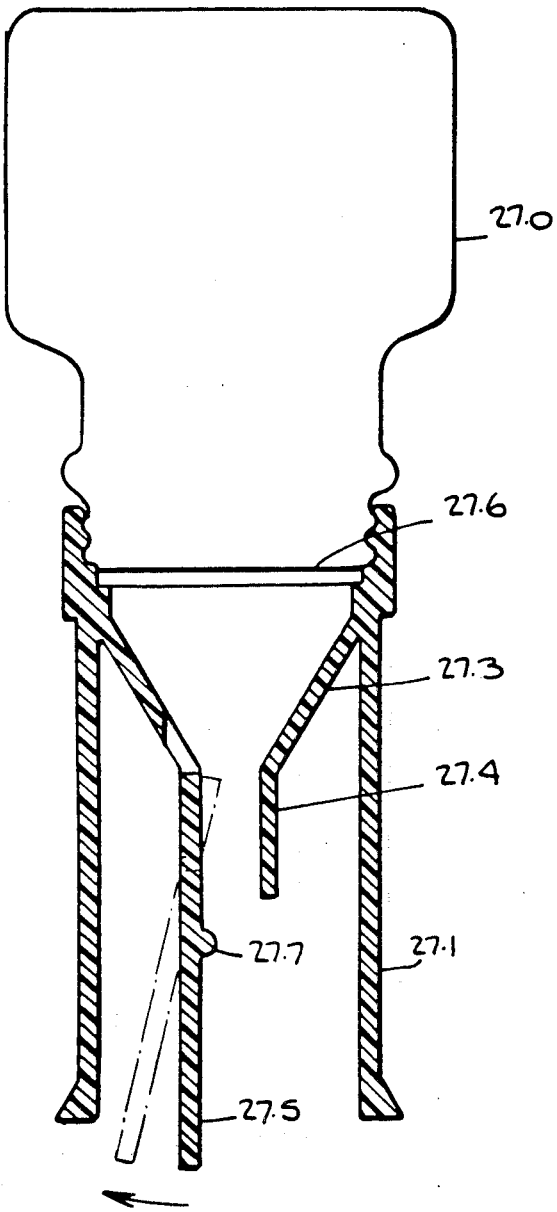
FIG. 27 is a longitudinal section view of an alternate embodiment wherein a single gate means is mounted on a vertical member resiliently attached to the funnel guide.
Figure 28:
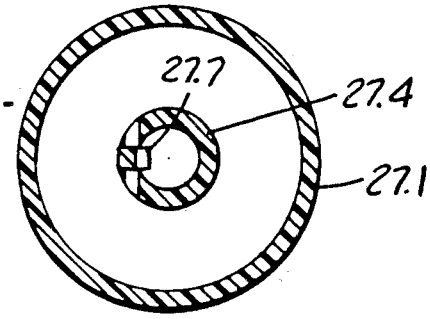
FIG. 28 is a cross section view of said alternate embodiment showing gate means blocking the delivery tube.

In a further modified embodiment of the invention illustrated in FIGS. 27 and 28 a simplified structure is shown. In this embodiment the delivery mechanism is a single cylinder connected at one end to a small object storage bottle 27.0 and containing a distributor disk 27.6 and integrally attached to its inner wall a funnel guide 27.3 terminating in a delivery tube 27.4. On one wall of the delivery tube there is resiliently attached a bar member having a protuberance 27.7 acting as a blocking gate to prevent passage of small objects from the delivery tube. One end of the resiliently mounted bar member 27.5 protrudes from the delivery end of the device and is actuated by sidewise displacement thereby unblocking the delivery tube 27.4 and allowing exit of a small object.

Figure 29:
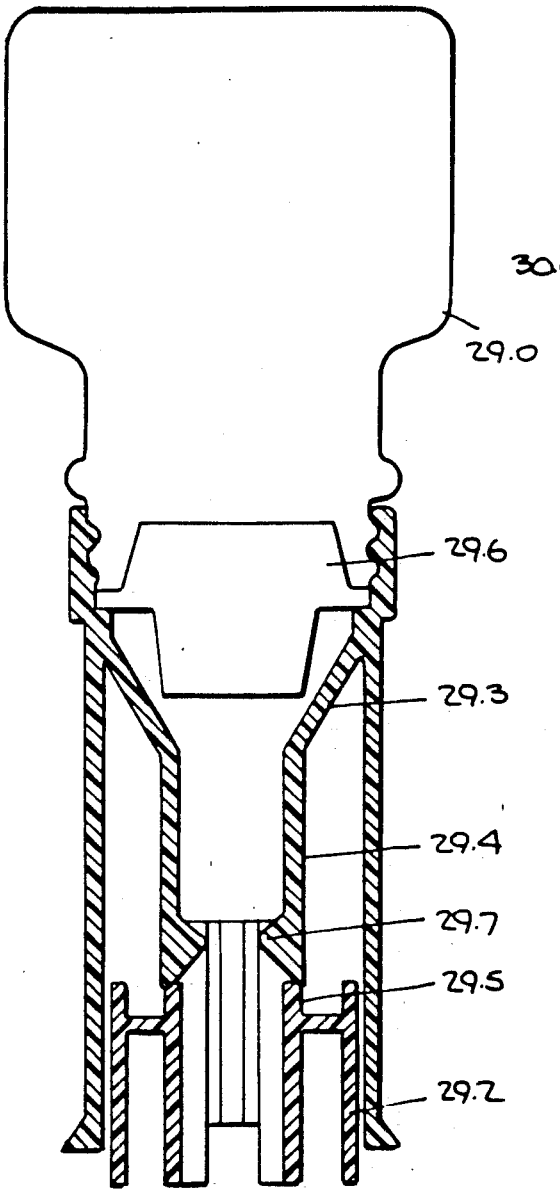
FIG. 29 is a longitudinal section view of an alternate embodiment wherein the gate members are resiliently mounted on the funnel guide and the gate opening members are rigidly mounted on the telescoped inner cylinder.
Figure 30:
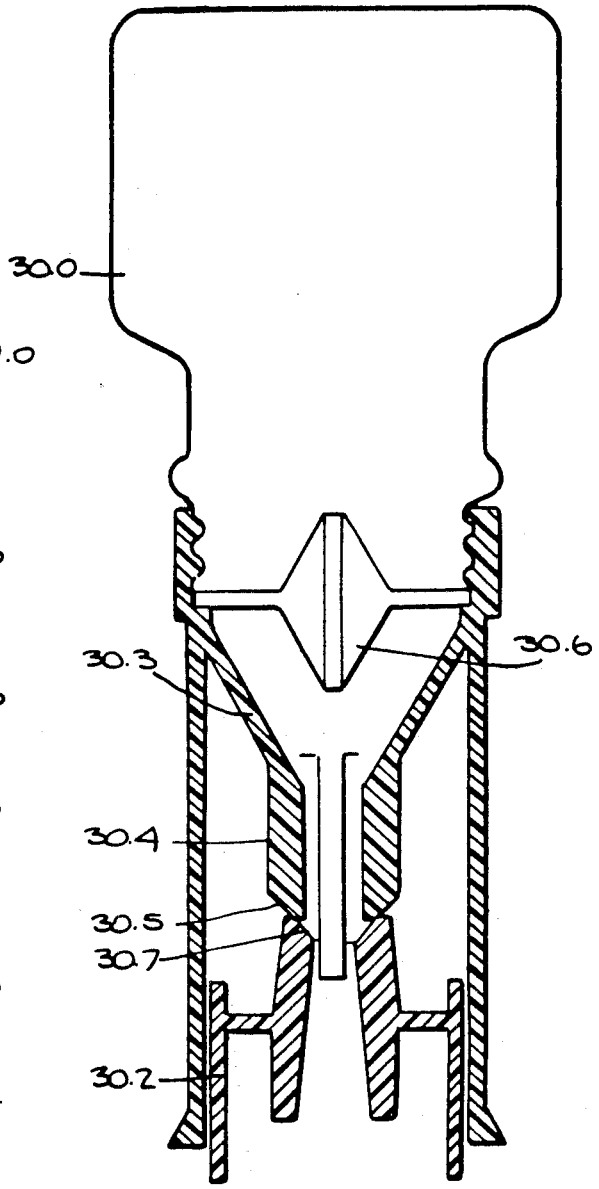
FIG. 30 is a longitudinal view of an alternate embodiment wherein the delivery tube ends act as the gate opening members and the gate members are resiliently mounted on the inside of the telescoped inner cylinder.

In other further modified embodiments of the present invention there are illustrated in FIGS. 29 and 30 delivery devices particularly adapted for disk-shaped tablets. In both of these devices the delivery mechanism is connected to storage bottles 29.0 and 30.0 and contains at the entry end a diamond shaped distributor divider 29.6 or 30.6 below which is a funnel guide 29.3 or 30.3 terminating in a capsule delivery tube 29.4 or 30.4. In FIG. 29 the delivery tube has flexibly mounted protuberances 29.7 extending into exit end of the delivery tube. These protuberances acting as gate members are spread in the operating position by pressing the delivery end of the internal cylinder 29.2 into the user's hand which forces the rigidly mounted gate opening bar members 29.5 against the protuberances 29.7 freeing the exit end of the delivery tube.

In the device of FIG. 30 the delivery tube is rigid and terminates in an outwardly beveled ramp 30.5. A slidably enclosed inner cylinder 30.2 has resiliently mounted bar members 30.7 which block the entrance to the delivery tube exit port in the rest position. In the operating position the inner cylinder is pressed into the user's hand which spreads the upper ends 30.7 of the gate bar members and allows a small object to drop from the delivery tube into the user's hand.

Figure 31:
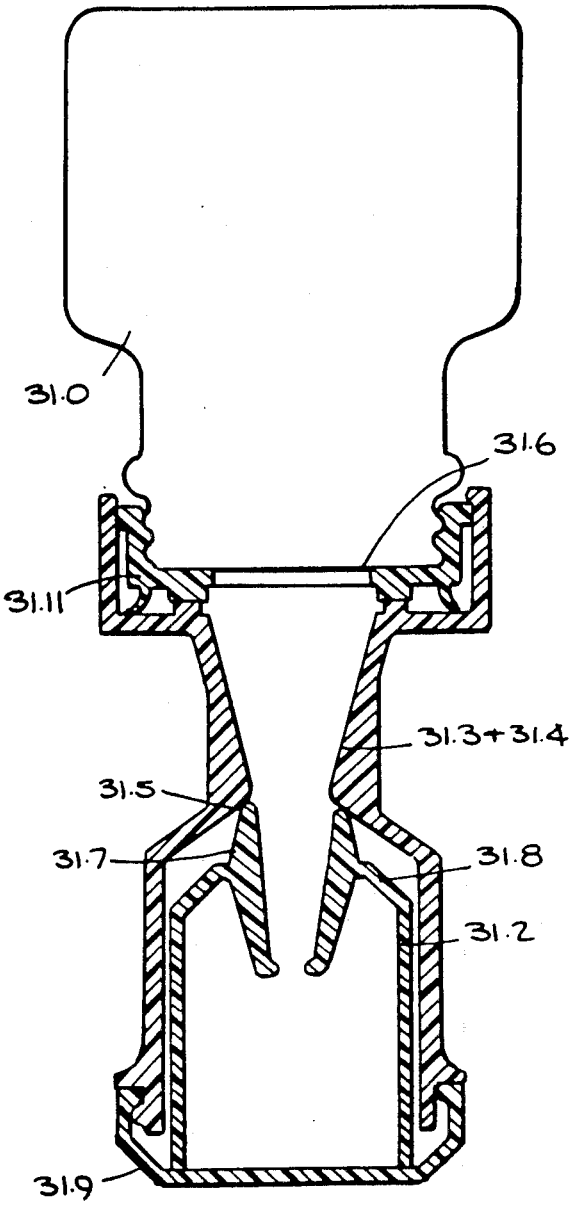
FIG. 31 is a longitudinal section view of an alternate embodiment wherein the storage bottle is connected to the delivery device by means of a childproof cap connection and the distributor screen is an integral part of said childproof cap.

In a further embodiment a structure illustrated in FIG. 31 has internal operating structure similar to that illustrated in FIG. 22 but has a child resistant closure 31.9 covering the exit end of the device and has the delivery device connected to the storage bottle 31.0 by means of a child resistant closure 31.11. After removal of the cap 31.9 the device is operated in the same manner as the embodiment of FIG. 22.

As it may be appreciated the invention has been disclosed in its preferred embodiments and it may be apparent by those skilled in the art that these embodiments are subject to modifications. These modifications will be considered within the scope of the invention which is limited by the claims which follow.

What is claimed is:

1. A medicament storing and dispensing device for dispensing single small objects comprising:

(a) an outer receptacle which has an inner structure which divides said outer receptacle into an upper storage compartment and a lower delivery compartment, with a small object delivery tube which is part of said inner structure and innerconnects said upper storage compartment and said lower delivery compartment and which has a beveled end ramp at its lower delivery compartment end;

(b) an inner receptacle slidably-enclosed by the lower compartment of said receptacle, said inner receptacle having an inner structure for receiving and dispensing small objects upon reciprocal motion of the inner receptacle within said outer receptacle; and (c) a resiliently-mounted gate means attached at one end to the inner structure of said inner receptacle so that said resiliently-mounted gate means exerts a force on said beveled end ramp which tends to separate said outer and inner receptacles, whereby entry of small objects into the inner receptacle is controlled upon reciprocal motion of the inner receptacle within said outer receptacle.

2. A medicament storing and dispensing device for dispensing tablets comprising:

(a) an outer receptacle containing the tablets to be dispensed which has an inner structure which divides said outer receptacle into an upper storage compartment and a lower delivery compartment, and a tablet delivery tube which is part of said inner structure and interconnects said upper storage compartment and lower delivery compartment and which has an outwardly-beveled end ramp at the lower delivery oompartment;

(b) an inner receptable slidably-enclosed by the lower compartment of said outer receptacle, said inner receptacle having an inner structure for receiving and dispensing tablets upon reciprocal motion of the inner receptacle within said outer receptacle which inner structure comprises bar-shaped gate means resiliently-mounted on the inner structure of said inner receptacle and vertically positioned for controlling the release of tablets from said tablet delivery tube upon reciprocal movement of the inner receptacle.

3. The medicament storing and dispensing device of claim 2, wherein said bar-shaped gate means have enlarged upper ends positioned in sliding contact with the outwardly-beveled end ramp, whereby said bar-shaped members are spread apart when said inner receptacle is externally pressed into an operating position within said outer receptacle and return to a rest position partially blocking the tablet delivery tube when external pressure is released.

4. The device of claim 2, wherein said tablet delivery tube is of a rectangular cross-section, which restricts tablets within the tablet delivery tube to an edge-to-edge alignment.

5. A medicament storing and dispensing device for dispensing single small, capsule-shaped objects comprising:

(a) an outer receptacle containing the small, capsule-shaped objects to be dispensed which has an inner structure which divides said outer receptacle into an upper storage compartment and a lower delivery compartment, and a capsule-shaped object delivery tube which has relatively thick walls, is part of said inner structure and interconnects said upper storage compartment and said lower delivery compartment and which has an inwardly-beveled end ramp at its lower delivery compartment end; and (b) an inner receptacle slidably-enclosed by the lower compartment of said outer receptacle, said inner receptacle having an inner structure for receiving and dispensing capsules upon reciprocal motion of the inner receptacle within said outer receptacle, wherein the inner structure of said inner receptacle comprises:

(i) a plurality of resiliently-hinged members attached at one end to the inner wall of said inner receptacle and having a second end; and (ii) a plurality of arcuate members having upper and lower ends and convex and concave faces, each arcuate member being attached on its convex face to the second end of one of said resiliently-hinged members, such that the concave faces of the arcuate members are arranged to form a ribbed, cagelike holder, whereby, in a rest position, the lower ends of the arcuate members converge to less than a capsule diameter apart to form a gate sufficient to prevent exit of the capsule-shaped objects therefrom, and the upper ends of the arcuate members are spread apart to receive a capsule-shaped object from the capsule-shaped object delivery tube, in an operating position, the upper ends of the arcuate members converge to less than a capsule diameter apart to prevent exit of the capsule-shaped objects from the capsule-shaped object delivery tube and the lower ends of the arcuate members are spread apart to dispense a capsule-shaped object therefrom, said arcuate members being positioned to slide, with the reciprocal motion of said inner receptacle, against said inwardly-beveled end ramp and thereby exert a force on said inwardly-beveled end ramp which tends to separate said outer and said inner receptacles, with said inner and said outer receptacles being provided, on their opposing faces, with integrally-attached circumferential rings or shoulders, said rings or shoulders preventing the escape of the inner receptacle from the outer receptacle.

6. A medicament storing and dispensing device for dispensing single small, capsule-shaped objects according to claim 5, wherein the outer receptacle contains a distributing and aligning disk having opening adapted to align the capsule-shaped objects approximately along the axis of the capsule-shaped object delivery tube, said distributing and aligning disk being peripherally fitted to the inner walls of said upper storage compartment.

7. The medicament storing and dispensing device of claim 6, wherein said inner structure which divides said outer receptacle consists of a funnel-shaped capsule delivery guide which is integrally formed with the inner walls of said outer receptacle at the circumference of the wide opening of the funnel-shaped capsule delivery guide and which terminates at its narrow opening in the capsule-shaped object delivery tube.

8. The device of claim 6, wherein said distributing and aligning disk has a single opening in the shape of a sexafoliate circle or sexfoil.

9. The device of claim 6, wherein said upper storage compartment of said outer receptacle is provided with a locking closure for attachment to the neck of a standard capsule bottle.

10. In a medicament storing and dispensing device for storing and dispensing small objects, an improvement which comprises a delivery mechanism comprising a receptacle conduit having an entry port which is connectable to a small object storage container, an exit port, and an inner structure comprising a funnel-shaped small object guide terminating at its narrow opening in a delivery tube sized to accommodate no more than one small object at a time and a resiliently-mounted gate means for blocking the escape of a small object from the delivery tube when the gate means is in a rest position, and for releasing a small object when the gate means is in an operated position and gate opening means for providing a biasing force to the resiliently-mounted gate means to move it from the rest position to the operated position.

11. The medicament storing and dispensing device of claim 10, wherein the delivery tube has a beveled end ramp, and said gate opening means comprises members which are rigidly attached to an inner cylinder slidably enclosed within the receptacle conduit, said member being positioned to provide said biasing force against the resiliently-mounted gate means.

12. The medicament storing and dispensing device of claim 10, wherein the resiliently-mounted gate means are members which are pivotally-mounted at the end of the delivery tube.

13. The medicament storing and dispensing device of claim 10, wherein the resiliently mounted gate means is a single bar member having a protuberance partly blocking the delivery tube in the rest position.

14. The medicament storing and dispensing device of claim 10, wherein the resiliently-mounted gate means are gate members which are pivotally-mounted and enclosed by a rotatable disk with a parallelogram-shaped opening.

15. The medicament storing and dispensing device of claim 10, wherein the delivery mechanism further comprises an internal distributing means integrally formed within the receptacle conduit between the entry port and within the funnel-shaped small object guide, and said gate opening means comprises an inner cylinder which is slidably enclosed within said receptacle conduit and which has the resiliently-mounted gate means attached thereto.

16. The medicament storing and dispensing device of claim 10, wherein said gate opening means comprises an inner cylinder slidably enclosed within the receptacle conduit and an internal distributor means integrally formed within the receptacle conduit between the entry port and within within the funnel-shaped small object guide, and the resiliently-mounted gate means are gate members having protuberances which block said delivery tube in the rest position and the inner cylinder has rigidly-mounted internal bar members which are positioned to provide said biasing force against said gate members in the operated position.

17. The medicament storing and dispensing device of claim 10, wherein the resiliently-mounted gate means comprises resiliently-mounted members each of which has one end partially blocking the delivery tube and an opposite end protruding from the exit port of said medicament storing and dispensing device.

18. The medicament storing and dispensing device of claim 10, wherein the resiliently-mounted gate means consists of a single bar resiliently mounted on the delivery tube, said bar having a protuberance partially blocking the delivery tube, and said gate opening means comprises a portion of said bar protruding from the exit port of said device.

19. The medicament storing and dispensing device of claim 10, wherein the resiliently-mounted gate means comprises flexibly-mounted protuberances mounted on the delivery tube and extending into the delivery tube and said gate opening means comprises an inner cylinder slidably enclosed within the receptacle conduit which has rigidly-mounted bar members positioned to provide said biasing force against said flexibly-mounted protuberances.

* * * * *